United States Patent [19]

Sainton

[11] Patent Number: 4,846,602

[45] Date of Patent: Jul. 11, 1989

[54] METHOD OF REGENERATING A WORN ROAD SURFACE

[75] Inventor: Alain Sainton, Paris, France

[73] Assignee: Beugnet, Arras, France

[21] Appl. No.: 177,781

[22] Filed: Apr. 5, 1988

[30] Foreign Application Priority Data

Apr. 9, 1987 [FR] France ..... 87 05005

[51] Int. Cl.[4] ..... E01C 7/06

[52] U.S. Cl. ..... 404/75; 404/93

[58] Field of Search ..... 404/72, 75, 82, 101, 404/111, 90–92; 299/39; 106/273 R, 276–278, 281 R, 282, 283

[56] References Cited

U.S. PATENT DOCUMENTS

| | | | |
|---|---|---|---|
| 2,211,262 | 8/1940 | Flynn | 404/92 X |
| 3,819,291 | 6/1974 | McConnaughay | 404/82 X |
| 4,011,023 | 3/1977 | Cutler | 404/91 |
| 4,194,023 | 3/1980 | Cushman et al. | 404/82 X |
| 4,226,552 | 10/1980 | Moench | 404/92 |
| 4,238,241 | 12/1980 | Schneider | 106/281 R |
| 4,300,853 | 11/1981 | Jones | 404/101 X |
| 4,373,961 | 2/1983 | Stone | 106/281 R |
| 4,473,320 | 9/1984 | Register | 404/92 X |
| 4,637,753 | 1/1987 | Swisher, Jr. | 299/39 X |

FOREIGN PATENT DOCUMENTS

| | | | |
|---|---|---|---|
| 2485057 | 12/1981 | France | 404/91 |

*Primary Examiner*—Jerome W. Massie, IV
*Assistant Examiner*—Gay Ann Spahn
*Attorney, Agent, or Firm*—Clifford A. Poff

[57] ABSTRACT

Method of regenerating a worn road surface when using a road surface reconditioning machine.

A method characterized in that in a first phase the characteristic features and content of regenerating binder which must be added to obtain a regenerated coating of which the characteristic features correspond to those of the initial surfacing material are determined and then, in a second phase, the worn surfacing material is cut away by means of particular cutting/milling apparatus in order to break up the cut material which is conveyed to the level of the mixing apparatus where regenerating binder is added, the characteristic features of which have been determined during the course of the first phase.

20 Claims, No Drawings

METHOD OF REGENERATING A WORN ROAD SURFACE

The present invention relates to a method of regenerating while cold a worn road surface consisting of granular material coated with a binder, by using a per se known road surface regenerating machine consisting particularly of a self-propelled vehicle comprising, in the direction of travel, milling means, means of mixing the milled products with the addition of a regenerating binder and means of spreading onto the road surface the coated materials which are thus treated.

It is conventional for road to be surfaced with granular materials coated in a bituminous binder and to a depth of at least 4 cm.

After a number of years, these surfacings age due to deformation resulting from traffic, climatic conditions (snow, ice . . . , etc.) salt applied during winter months and also light (photochemical aging). Taken as a whole, these various effects result in a hardening of the binder due to volatilisation of its lightest constituents; the result is that the product becomes fragile, breaks and has a tendency to crack. Another reason for deterioration is detachment of the road carpets, often due to poor attachment at the road building state. It is consequently vital to provide a treatment which makes it possible for the road surface to regain its initial properties.

To carry out this renewal, various solutions have already been suggested:

The first and the most simple resides in adding a layer of coated material to that which has aged or which has suffered the deterioration. This solution is not likely to give complete satisfaction because the fresh layer does not always adhere properly to the old one and is likely to become detached. Furthermore, there is the risk of ending up with road surfaces which are too thick, which is also not without its problems. Furthermore, this solution is not likely to resolve the problem of detachment of the subjacent layer and is therefore not satisfactory from the point of view of mechanical reinforcement.

Another solution is to cut away the existing layer of coated material which is dumped and replacing it with a new one; this method has the advantage of providing a road surface which is at the initial level; however, this solution is not entirely satisfactory either firstly from the economic point of view, since it is expensive, and secondly with regard to the protection of the environment, since it gives rise to considerable waste which can only build up on the dumping sites.

During the course of recent years, in order to remedy these drawbacks, methods of regenerating a road surface by heat treatment have been perfected which reside in heating the road surface over a depth of a few centimetres by using radiant panels, a part of this thickness then being scraped at surface level, the surface coating then being replaced by now coated materials (thermoregeneration), or alternatively by carrying out a surface mixing process, blending in regenerating binders (thermorecycling). Although it is possible to obtain satisfactory results, these methods do have the disadvantage of being particularly expensive because the cost of the heat energy needed for heating the surface of the worn out roadway represents approximately 50% of the total prime cost of carrying out the method.

To remedy these disadvantages, thought has been given to recycling the coated material in the cold state; the first attempts to carry out such operations involved relatively antiquated methods which were then improved by the perfection of veritable regeneration workshops consisting of self-propelled vehicles comprising, in the direction of travel, cutting means, means of mixing the milled off products with the addition of a regenerating binder and also means of distributing over the roadway the coated materials which had been thus treated.

French Pats. Nos. 85 12 724, 86 03 362, 87 02 856, for instance, describe such machines.

Experience has shown that in spite of their certain advantages, the use of the above-mentioned machines did not always make it possible, upon completion of the process, to obtain a satisfactory covering corresponding to the initial covering prior to intervention, which meant that it therefore required the provision of a fresh carpet layer.

The object of the present invention is to remedy these drawbacks by proposing a method which makes it possible at any time to control the various operations which occur when a regeneration workshop such as that mentioned above is put into operation, doing so from both the mechanical and also the chemical points of view, acting mainly on the characteristics relating to the cutting away of the coated materials, and the features of the regenerating binder added during the course of mixing, so that it is possible to redeposit on the road surface a product of predetermined properties which correspond essentially to those of the produce initially laid prior to ageing.

When laboratory tests establish the characteristics of a worn surfacing material on the basis of samples previously taken from the roadway, it is realised that these are very different from those of the surfacing which was laid in the first instance, these differences being mainly due to a substantial diminution in the bituminous binder content and a substantial change in the composition of the binder due to the disappearance of its lightest fractions.

These changes can be brought to light studying the granular nature of cut material obtained with a conventional milling cutter, and also the penetration capacity of the binder present in the cut material after extraction with a solvent.

If a trace is drawn to give the percentages of undersized materials accumulating from cut material obtained with a conventional milling cutter as a function of the size of the screen used, a curve is obtained, hereinafter referred to as curve C, in which the percentage of undersized materials decreases quite rapidly to become nil in the case of a screen with a mesh which is still relatively high (see attachment).

If the binder is removed from this aged coating by extraction with a solvent and if the granular structure of the resultant coated material is measured, then a curve is obtained, hereinafter referred to as curve A, which corresponds to that of the initial surfacing material; if it is compared with the curve C. The former is far more continuous and has a far less pronounced slope; the percentages of undersized materials corresponding to smaller mesh screens are far more substantial. During the operation of surface regeneration, one starts with a type C curve and seeks at the end of the proces to arrive at a curve which is as close as possible to the type A curve.

Moreover, one of the characteristic features of the bituminous binders most frequently studied in order to determine the properties of these binders is their penetration capacity at 25° C. (AFNOR standard NFT 66 004): to measure this latter, a crucible containing the bituminous binder is placed in a bain-marie at 25° C. and on its surface is placed a needle carrying a weight of 100 g and the amount by which it sinks in 5 seconds is measured. While experience shows that starting from a penetrability level of between 60 and 70, the penetrability of a binder which is aged for about 10 years falls to some 5 to 20 tenths of a millimetre. This difference in penetration capacity corresponds to the abovementioned disappearance of certain light fractions from the binder and explains that, in the end, after regeneration of a surfacing material which has approximately the characteristic features of the initial binder, it is necessary to resort to a regenerating binder which has a far higher rate of penetration.

On the basis of these few theoretical considerations, the object of the invention is to perfect a method for the cold regeneration of a worn road surface which makes it possible to redeposit on the surface a regenerated covering material, the characteristics of which are as close as possible to those of the surfacing which as originally laid.

To this end, the method according to the invention is characterised in that first phase laboratory tests are conducted to establish the characteristic features of the worn coating material, particularly the nature of the granulate and also the content and characteristic features of the binder and then, on a basis of the values thus determined, the characteristic features and content of the regeneration binder are calculated before it is added when the regenerating machine is used to the mixing elements, in order to obtain a regenerated surfacing of which the characteristics correspond substantially to those of the initial surfacing material and this result is verified under laboratory conditions and then, in a second phase, the regeneration operation is carried out by means of the regenerating machine, by cutting away the worn surfacing to a predetermined thickness by means of per se known cuttingn meansn consisting of at least one cutting/milling rotor disposed in a decohesion chamber fitted with decohesion bars and consisting of a driving tube disposed substantially transversely to he direction of travel of the machine and on which there are welded windings, each of which carries a series of teeth particularly provided with tungsten carbide tips in such a way as to break up the milled material and then, bringing the chemically treated milled material to the mixing means where the regenerating binder is added, the characteristic feataures of this binder having been established during the first phase of the process, the consequently regenerated surfacing material then being conveyed to the distributing means which spread it over the road.

Therefore, this method makes it possible completely to control the characteristic features of the surfacing material which is deposited at the end of the process so that they correspond substantially to those of the initial surfacign material thanks to the use, in combination, of mechanical means (particular characteristics of the cutting and mixing members) which make it possible to break up the milled products regardless of the rough grinding effect which is achieved with conventional cutting means) and chemical means permitting of a rational choice of othe quantity and features of the regenerating binder added at the blending stage.

Experience shows that the method according to the invention makes it possible, on a basis of the graph C, to obtain upon completion of treatment a graph similar to heg raph B, and which is therefore substantially close to the graph A corresponding to the initial surfacing material.

According to another characteristic feature of the invention, the regenerating binder consists of a bitumen or a mixture of bitumens having a high penetration capacity and heavy oils of a naphtheno-aromatic naturea nd distinquished from conventional bitumens of a close consistency by low asphaltene contents and high contents of aromatic compounds. The aforesaid comments and the followig description of the present invention will be better understood with reference to the appendix herein, which illustrates the aforesaid graphs or curves A, B and C in terms of the percentage of cumulative waste material and the percentage of cumulative undersized materials.

Experience shows that the penetration capacity of the regenerating binder is often better than 60 tenths of a millimetre.

Among the regenerating binders which may be advantageously used within the framework of the method acording to the nvention, we can quote the produces marketed by the SHELL Company under the trade marks "RJO 100", RJO 200", "RJO 400", "RJO 800"and "RJO 1002". Other products can likewise be used for a similar purpose, including products marketed by the ESSO Company under the commercial designations FLEXO 110 and FLEXO 150.

According to another characteristic feature of the invention, there is added to the regeneratingn binder approx. 10% of a wetting agent adapted to accelerate the process of decohesion of the cut material by softening the worn binder.

This wetting agent, which consists of an essential aromatic solvent and of which the flash point in an enclosed vessel (standard NFT 60 103) is greater than 50 (for an aromatics content comprised between 50 and 100%), is not an integral part of the regenerating binder, but exerts a chemcial action on the cut material which it helps to crumble.

It is possible to quote as an eample of a wetting agent the product marketed by the ESSO Company under the designation HAN 8070.

By virtue of its volatile character, this solvent disappears during the "hardening off" of the coated materials after a few weeks following use. Then only the regenerating agents remain, and they are stable.

Experience has shown that the association of regenerating binder and wetting agent, combined with the use of cutting means having a particular configuration, made it surprisingly possible to obtain a regenerated surfacing material of which the properties are particularly cose to those of the surfacing material originally used.

According to another characteristic feature of the invention, the total quantity of regenerating binder which has to be added to the cut material in the mixing equipment is calculated by the formula (1)

$$Xn = \frac{Xv}{100 - y}$$

and the penetration capacity of this binder by the formula (II)

$$\left(1 - \frac{Xv}{Xn}\right)\log Pr = \log Pn - \frac{Xv}{Xn}\log Pv,$$

in which:

Xn represents the content of chosen binder in the coated material after recycling (parts per hundred parts of granular material)

Xv is the binder content of the worn coated material (parts per hundred parts of granular material)

y the percentage of regenerating binder in the binder of the coated material after recycling Pr is the penetration capacity of the regenerating binder Pn is the penetration capacity chosen for the binder of the coated materials after recycling, and Pv is the penetration capacity of the wornbinder.

In accordance with the implementation of the method according to the invention, there is likewise provision for spreading on the surface of the roadway an adhesion layer prior to deposition of the regenerated surfacing material; this layer may simply be constituted by a layer of the regenerating fraction distributed homogeneously and at a rate proportional to the surface area to be treated.

According to another characteristic feature of the invention, there is added to the cut material in the mixing means and downstream of the regenerating fraction 0.1 to 0.5% and preferably among 0.25% by weight of synthetic fibres particularly polyacrylonitrile fibres considered in relation to the weight of cut material. These fibres make it possible to improve the traction resistance of the regenerated coated materials.

Furtheremore, when the method according to the invention is put into practice, it has been found that the teeth of the cutting rotors become heated very quickly and must of necessity be cooled continuously to avoid the risks of strain hardening and premature wear and tear. To remedy this drawback, the habit has been adopted of sprayng water onto the turns of the rotors (about 0.5 to 2% by weight in relation to the weight of cut material); unfortunately, although it makes it possible to avoid excessive overheating of the rotor teeth, this spraying is not without its problems following the procedure, particularly during the course of the mixing operation, since it is well known that water is an enemy of hydroarbonated binders, whose adhesive capacity it reduces.

To compensate for this phenomenon, according to another characteristic feature of the invention, when the milling/cutting is being performed, the teeth of the milling rotor or rotors are cooled continuously by spraying an aqueous solution containing 5 to 40% and preferably about 10% of a surface active agent which is chosen particularly from the group consisting of the amines, the polyamines and the amino hydrochlorates.

The object of this surface active agent is to improve the cut material-regenerating binder contact by "doping" the interface between these two compounds.

The characteristic features of the method which is the object of the invention and in particular the first phase thereof will be described in greater detail on the basis of the examples mentioned hereinafter:

EXAMPLE I

A sample of worn motorway material cut with a conventional milling cutter and having the following characteristic features was taken:

| Granular make-up | |
|---|---|
| Screen in mm | % passing |
| 20 | 93% |
| 16 | 86% |
| 12.5 | 73% |
| 10 | 55% |
| 8 | 34% |
| 6.3 | 22% |
| 4 | 11% |
| 3.15 | 9% |
| 2 | 6% |
| 1 | 3% |

Binder content: 4.6% instead of 5.6% for the original nonaged binder

Penetration capacity at 25° C., 26/10ths of a millimetre instead of 65/10ths of a millimetre for the original binder taken under the same conditions.

After extraction by solvent, the followig granular makeup was discovered, which corresponds to that of the initial surfacing material:

| Screen in mm | % passing |
|---|---|
| 10 | 92% |
| 8 | 71% |
| 6.3 | 53% |
| 5 | 43% |
| 3.15 | 37% |
| 2 | 33% |
| 1 | 26% |
| 0.5 | 20% |
| 0.315 | 17% |
| 0.08 | 10% |

These granulations correspond respectively to the curves C and A on the attached diagram.

There was then added to the cut material corresponding to the original worn surfacing material 1.98% of a regenerating fraction consisting of:

Regenerating binder: 13.2% RJO 200 SHELL 86.8% RJO 800 SHELL (penetration capacity at 25° C.: 66/10ths of a millimetre)

Wetting agent: 10% of the solvent HAN 8070 ESSO.

The regenerating quantity (excluding wetting agent) and its penetration capacity were calculated on the basis of the above formulae I and II.

After mixing at 18° C., there was thus obtained a regenerated binder of the following specifications:

Granularity

| Screen in mm | % passing |
|---|---|
| 10 | 95% |
| 8 | 76% |
| 6.3 | 58% |
| 5 | 49% |
| 3.15 | 41% |
| 2 | 37% |
| 1 | 29% |
| 0.5 | 22% |
| 0.315 | 19% |

-continued

| Screen in mm | % passing |
|---|---|
| 0.08 | 11% |

Penetration at 25° C.: 67/10ths of a millimetre (instead of the theoretical 65).

The thus treated coated material corresponds to the attached graph B. It is seen therefore that the above-mentioned treatment has made it possible to obtain a surface covering of which the characteristic features are close to those of the initial binder represented by the attached graph A.

The characteristics of this regenerated surfacing were then measured, using the DURIEZ method. The following results were found:

DURIEZ - LCPC compacted at 18° C.

Compactness in %: 94%

Ro in MPa 24 hours: 4.4

EXAMPLE 2

Starting with the same original worn cut material as in Examples 1, an aqueous solution was sprayed onto it, composed as follows:

80% water

20% Dinoram 50 (aqueous dispersion of amines, CECA) at the rate of 1% by weight in relation to the initial cut material.

Then the same operations were carried out as for the first Example, the result being a regenerated coated material having the following characteristic features:

Penetration capacity of the regenerating binder at 25° C.: 70 (for a theoretical 65).

| MECHANICAL STRENGTHS - DURIEZ LCPC TESTS (on recompacted samples at 18° C.) - COMPACTNESS 95% | | |
|---|---|---|
| | 24 hours | 8 days |
| Ro 180° C. MPa | 3.2 | 3.7 |
| ro after immersion MPa | | 2.8 |
| r/R | | 0.75 |

EXAMPLE 3

Exactly the same procedure was adopted as in Example 2 except that in the mixer, after the regenerating binder, there were incorporated 0.25% by weight (in relation to the cut material) of polyacrylonitrile fibers 100 detex 24 mm VFII from Hocchst. The result was a regenerated binder having the followig DURIEZ LCPC characteristics at 18° C.:

Compactness: 95%

Rc 8 days in MPa 18° C.: 4.15

These results show that the method according to the invention makes it possible to obtain regenerated surfacing materials having mechanical properties and characteristic features which are very close to those of the initial surfacing material used prior to its being worn.

APPENDIX
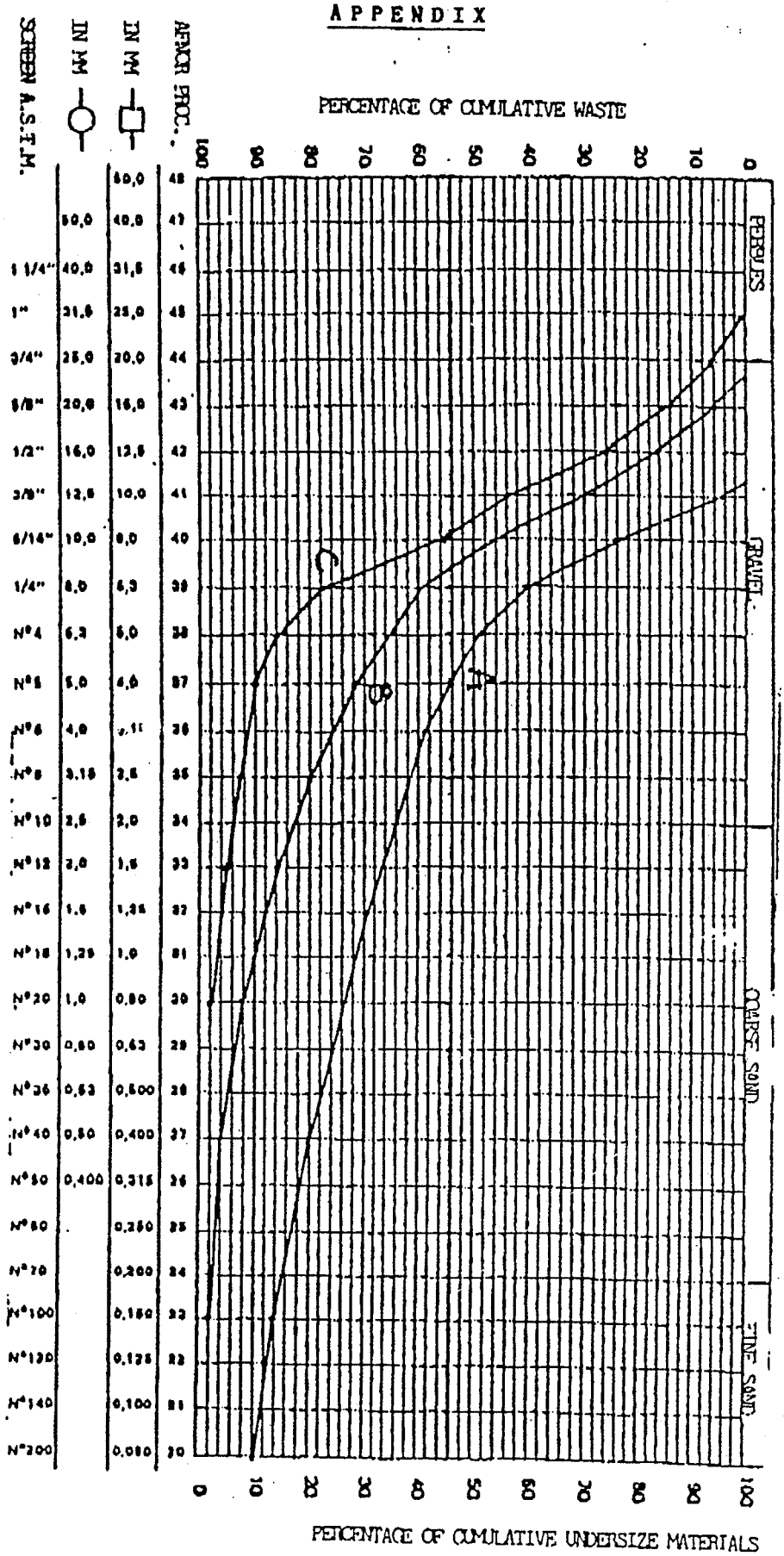
EXPRESS MAIL NO. B 109 303 80Y

What is claimed is:

1. In a method of operating in situ a regeneration road resurfacing plant for regenerating a cold worn road surface having a surface layer consisting of granular material coated in a bituminous binder the steps of:

conducting a first value determination of the nature oof the granular make up of the worn granular material and the content and characteristics of the binder of the worn material, employing said first determining values to establish a second value determination of the nature of the original granular material of the surface layer and the content and characteristics of the original binder of the surface layer, comparing said first and second corresponding values and making a third value determination of the granular material and binder necessary to achieve a regenerated surface layer made up of granular material and binder in terms of said values corresponding substantially to said values of the original surface layer, thereafter as an operative series of sequential machine operational steps, in which the worn surface is removed and replaced as a continuous in situ operation, removing and mechanically treating the surface layer and regenerating the mechanical treated material by a chemical treatment to obtain a granular make up corresponding substantially to that of said third value determination thereof, adding to the regenerated granular material a regenerating binder corresponding to that of said third value determination thereof, and thereafter depositing the regenerated surface material as a replacement road surface layer for the removed layer of the road surface.

2. Method according to claim 1, characterised in that the regenerating binder consists of a bitumen or mixture of bitumens of high penetration capacity and heavy oils of a naphthenoaromatic nature and distinguished from conventional bitumens of a close consistency by low asphaltene contents and high aromatic compound contents.

3. Method according to claim 1 wherein the regenerating binder are addeda bou 15% of a welling agent capable of accelerating the process of decohesion of the cut material by softening the worn binder.

4. Method according to claim 3, characterised in that the wetting agentn consists of an essentially aromatic solvent.

5. Method according to claim 1, wherein the total quantity of regenerating binder which has to be added to said regenerated material is calculated by the formula $$Xn = \frac{Xv}{100 - y}$$

while the penetration capacity of this binder is calculated by the formula $$1 - \frac{Xv}{Xn} \log Pr = \log Pn - \frac{Xv}{Xn} \log Pv$$

in which:

Xn represents the content of chosen binder in the coated materials after recycling (parts per hundred parts of granular material)

Xv is the content of binder in the worn coated material (parts per hundred parts of granular material)

Y is the percentage of regenerating binder in the binder on the coated material after recyling Pr is the penetration capacity of the regenerating binder Pn is the penetration capacity chosen for the binder on the coated material after recycling, and Pv is the penetration capacity of the worn binder.

6. Method according to claim 1, prior to the depositing of the regenerated surfacing material on the road surface, the step of applying to the road surface a layer consisting of the regenerating fraction.

7. Method according to claim 1, after the point where the regenerating binder is added, the step of adding to the cut material between 0.10 to 0.50% by weight of synthetic fibers, in relation to the weight of the cut material.

8. Method according to claim 1, step of employing teeth of a cutting rotor and continuously cooling said teeth by spraying onto them an aqueous solution containing between 5 to 40% of a surface active agent.

9. Method according to claim 8, characterised in that the surface active agent is chosen from the group consisting of the amines, the polyamines and the amino hydrochlorates.

10. Method according to claim 8, characterised in that the quantity of acqueous solution of surface active agent used corresponds to approx. 0.5 to 2% by weight in relation to the weight of cut material.

11. In a method according to claim 1, wherein said chemical treatment step includes the step of subjecting the worn granular material to a binder removing solvent to remove enough of the original binder from the worn granular material to yield said sought after value.

12. In a method according to claim 1, wherein said mechanical step comprises a cutting milling step.

13. In a method according to claim 1, wherein during said adding step said regenerating binder and said regenerated granular material are subject to a mixing action.

14. In a method according to claim 1, wherein said first and second values include, as to the granular material, a determination of the worn and original percentage of undersized granular material when compared with a predetermined size and, as to the binder, the quantity and penetration capacity of the worn and original binder.

15. In a method according to claim 1, wherein said second value determination includes the step of determining the quantity of the regenerating binder with reference to its penetration capacity which must be added to the regenerated granular material to produce a product with reference to its penetration capacity substantially the same as the original surface layer.

16. In a method according to claim 11, the additional step of employing a mixing machine and adding the regenerated granular material and the regenerating binder in said mixing machine.

17. In a method according to claim 11, the step of employing teeth of a cutting means, applying a aqueous solution of a surface active agent to effect a cooling of said teeth and doping of granular material to increase the adhesive capacity of the granular material and the binder relative to each other.

18. In a method according to claim 7, wherein approximately 0.25% of synthetic fibers is added to the cut material.

19. In a method according to claim 7, wherein said synthetic fibers consist of polacrylonitrile fibers.

20. In a method according to claim 8, wherein said aqueous solution consist of approximately 10% of said surface active agent.

* * * * *